United States Patent [19]

Day

[11] 4,345,841

[45] Aug. 24, 1982

[54] MULTI-STAGE CENTRIFUGAL MIXER

[75] Inventor: Roger W. Day, Houston, Tex.

[73] Assignee: Geosource Inc., Houston, Tex.

[21] Appl. No.: 161,396

[22] Filed: Jun. 20, 1980

[51] Int. Cl.[3] ..... B28C 5/06

[52] U.S. Cl. ..... 366/2; 366/14; 366/165; 366/341

[58] Field of Search ..... 366/3, 10, 15, 134, 366/14, 131, 150, 165, 177, 178, 179, 181, 182, 341, 262, 2, 6, 27, 33, 34, 37

[56] References Cited

U.S. PATENT DOCUMENTS

| | | |
|---|---|---|
| 830,543 | 9/1906 | Trump . |
| 1,036,871 | 8/1912 | Matheson . |
| 1,517,598 | 12/1924 | Stevenson . |
| 1,834,917 | 12/1931 | Gilchrist . |
| 2,235,998 | 3/1941 | Kleinschmidt . |
| 2,330,875 | 10/1943 | Ellis . |
| 2,465,628 | 3/1949 | Border . |
| 2,523,800 | 9/1950 | Woodson . |
| 2,528,094 | 10/1950 | Walker . |
| 2,778,223 | 1/1957 | Kimbrell . |
| 2,957,495 | 10/1960 | Ashbrook . |
| 3,154,295 | 10/1964 | Vogel . |
| 3,185,447 | 5/1965 | Hach . |
| 3,294,490 | 12/1966 | Hach . |
| 3,298,669 | 1/1967 | Zingg . |
| 3,741,533 | 6/1973 | Winn . |
| 3,893,659 | 7/1975 | Krish . |
| 3,946,993 | 3/1976 | Morlin . |
| 3,976,109 | 8/1976 | Bailey . |
| 3,994,480 | 11/1976 | Fothergill . |
| 3,998,433 | 12/1976 | Iwako . |
| 4,053,142 | 10/1977 | Johannes . |
| 4,092,013 | 5/1978 | Staaf . |
| 4,184,771 | 1/1980 | Day ..... 366/10 |

FOREIGN PATENT DOCUMENTS

| | | |
|---|---|---|
| 522772 | 4/1931 | Fed. Rep. of Germany . |
| 569552 | 2/1933 | Fed. Rep. of Germany . |
| 1179913 | 10/1964 | Fed. Rep. of Germany . |

OTHER PUBLICATIONS

The Bariod Quick-Mixer, IADC Conference on Valves, Agitators and Mixers for Surface Mud Systems, Oct. 4–6, 1977 & The Bariod Quick-Mixer Advertising Brochure.

TRW Missions Manufacturing Co. advertising material paper *Solid Addition Equipment Predicting Satisfactory Hopper Performance,* Henry A. Lee.

*Primary Examiner*—Robert W. Jenkins

*Attorney, Agent, or Firm*—Arnold, White & Durkee

[57] ABSTRACT

An apparatus and method for mixing liquid or a drilling mud with solids and a second liquid is disclosed. The apparatus provides an annular housing having a plurality of mixing chambers. An inlet passageway is tangentially connected to the innermost mixing chamber for feeding slurry material to be mixed with solids axially fed into the same mixing chamber. A discharge port is further provided and connected to the outermost mixing chamber for tangentially discharging the homogeneous mixture of slurry and solid materials from the outer mixing chamber at high velocities to an elevation above the inlet. The mixing operation is enhanced by the liquid/solid mixture spilling over a first partition wall and retaining its rotational velocity and direction of rotation while passing under a second partition wall and finally out the discharge port.

24 Claims, 5 Drawing Figures

FIG. 1
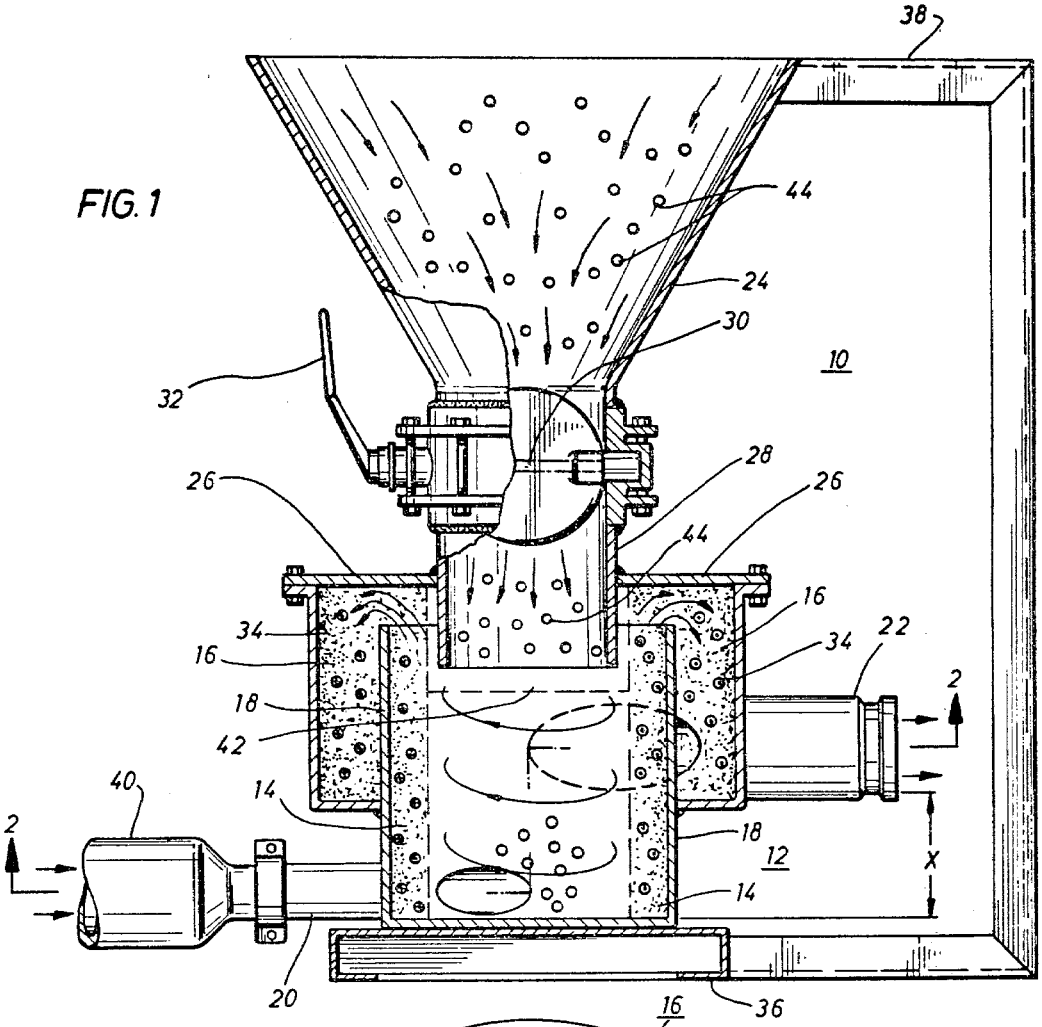
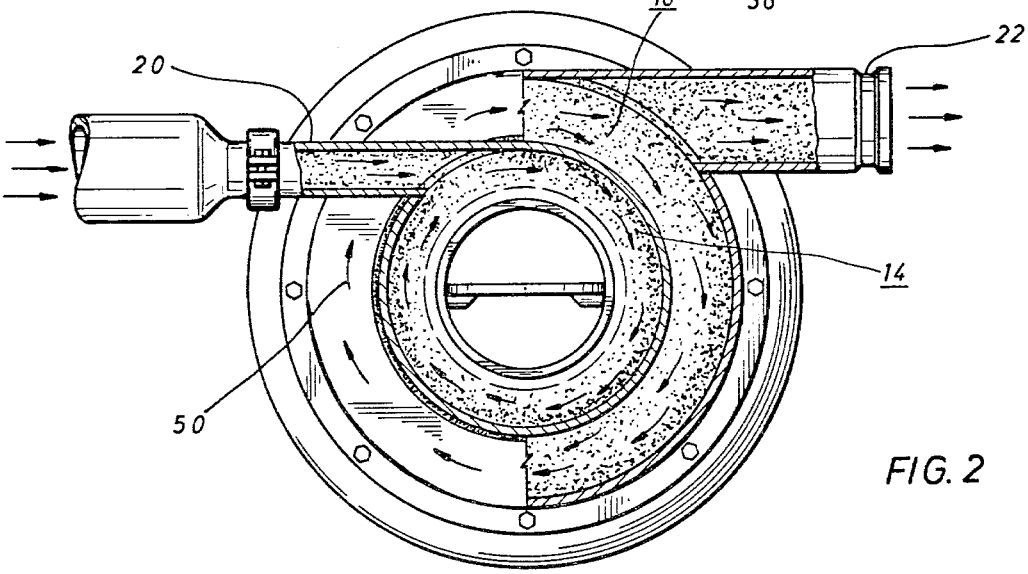
FIG. 2

MULTI-STAGE CENTRIFUGAL MIXER

BACKGROUND OF THE INVENTION

This invention relates to an apparatus and method for mixing liquid or drilling mud with solid or liquid materials and more particularly to a multi-stage centrifugal mud mixing device utilizing high rotational velocity for obtaining a homogeneous mixture of slurry and added materials.

In drilling for any hydrocarbon products it is necessary to control the hydrostatic head of the drilling mud at the bottom of the drill hole. The drilling mud is used for purposes of preventing geopressured hydrocarbon materials from coming to the surface. At the bottom of the hole surrounding the geopressured hydrocarbon materials are natural gases that are also under pressure, this pressure may be defined as formation pressure. The hydrostatic head of the drilling mud must be greater than this formation pressure to prevent the drilling mud from being blown out of the hole.

A second problem encountered in drilling for hydrocarbon materials is in bringing cuttings from the drill to the surface of the hole, that is, loose rock and debris cut by the drill bit from the bottom of the hole. A mud slurry is also injected into the hole for purposes of floating or carrying up these cuttings from the bottom of the hole.

For each of the above uses of mud slurry in the drilling operation for hydrocarbon products the density of the mud slurry as well as its viscosity is of great importance. For example, the deeper the drill hole the greater the formation pressure of the hydrocarbons found at the bottom of the hole and therefore the greater the mud slurry density required to maintain the proper hydrostatic head at the bottom of the hole. Overbalancing of the formation pressure by the hydrostatic head at the bottom of the drill hole prevents blow-out from the hole of natural gases and other hydrocarbon products as stated above.

Further, hydrocarbon drilling operations require the use of mud having a viscosity such that when injected into a drill hole will allow cuttings to be carried to the surface. This type of viscous mud slurry is obtained by mixing clay, or bentonite with water. In order to obtain the proper mud density for controlling the hydrostatic head at the bottom of the drill hole a mud slurry mixture is further concentrated with high density materials, such as barium sulfate, i.e. barite.

The prior art teaches several methods and devices for controlling the density and viscosity of mud slurry used in hydrocarbon drilling operations. One type of device deals with addition systems, which may be defined as a device connected to a continual flow system for purposes of injecting a second material into the continuous stream. The only actual mixing performed in such an addition system is any mixing that can be obtained from the movement of the flow material in its confined passageway. The addition system may be merely a second passageway connection for a liquid addition, or may be a funnel holding solid materials connected by a sleeve into the continual flow passageway.

As stated above an addition device will not actually perform a mixing operation, however, also taught in the prior art is a device having a solids hopper or funnel connected to a mixing chamber having an inlet passageway for providing a liquid or slurry to be mixed with solid materials. Mixing in this type of apparatus is enhanced by the use of a jet nozzle passageway carrying the mud slurry or liquid material into the chamber. The mud slurry or liquid is jet sprayed horizontally into the chamber as the solid materials are axially dispersed into the mixing chamber. Further mixing is accomplished in this device by attaching a venturi to the discharge port downstream from the jet mixer. The venturi provides reduction and enlargement of the discharge port which causes velocity change in the slurry thus enhancing turbulence before discharge and recovers part of spent energy. A distinct disadvantage of this venturi based mud mixing device is that it continually plugs with the solid materials which are axially fed into the mixing chamber and surround the jet spray. Since the vacuum created in the mixing chamber is not sufficient to assist in discharging the solids through the slurry, and the jet spray being only unidirectional cannot pick up all solids surrounding the inlet passageway and solid material, build-up results which requires manual cleaning before further use of the device. A further drawback of this type of system is in the capacity which is dependent upon the amount of port size reduction in the venturi. Although the capacity may be enhanced by a decrease in the port size reduction of the venturi, this expansion will detract from the mixing action caused after the reduction.

The prior art further discloses a mixing device utilizing two inlet ports to an annular mixing chamber having an axial extension passageway connected thereto. By applying a fluid into one inlet of the annular chamber tangentially, a high rotational velocity is obtained within the mixing chamber causing a vortex or air core to be formed in the axially extended passageway. A second fluid is interjected by a second inlet port into the mixing chamber axially and mixed with the first fluid by the rotational forces of the first fluid in the mixing chamber. As the mixture moves in the axial extension of the mixing chamber it continues to rotate in the same direction as the fluid in the annular housing. However, as the fluid is dispelled from the axial extension of the mixing chamber into a second chamber, before being discharged through a discharge port, the vortex is destroyed. This causes further turbulence of the fluids for mixing purposes and begins rotation in an opposite direction to that of the fluids in the mixing chamber. Such a device is disclosed in U.S. Pat. No. 2,957,495 by Ashbrook. This Ashbrook device makes no provision for injecting solid materials into the annular mixing chamber. Primarily used for mixing fluid into fluid or gas into fluid, any attempt to mix solid into a fluid would cause plugging in the device axial extension passageway of the annular chamber and render the device inoperative. Furthermore, high density materials, such as barite for example, not being flowable materials would render such a system as that found in Ashbrook inoperable since a nonflowable material would not be able to pass through the turn in the inlet passageway in the manner disclosed in Ashbrook without proper pumping of the solid.

SUMMARY OF THE INVENTION

In accordance with the present invention a multi-stage centrifugal mud mixer is provided having an annular chamber for receiving a mud slurry to be mixed with solid or liquid materials. The annular chamber is divided into a series of mixing chambers. The innermost mixing chamber receives the mud slurry from an inlet passageway that is tangential to the chamber. Solid materials, as for example barite, are added to the innermost mixing chamber by way of a funnel or solids hopper, which has an axial access into the mixing chamber. A second flowable material may also be added axially to the inner chamber for mixing. A discharge port is provided and tangentially connected to the outermost chamber of the annular housing for exhausting the homogeneous mixture of solids and slurry or liquid that have spilled over the partitioned walls separating the mixing chambers, while retaining enough kinetic energy to allow exhaustion at an elevation above the inlet passageway. The partition walls are located within the annular housing defining the series of mixing chamber such that the solids liquid composition spills over the partition wall separating the first from the second mixing chamber while flowing under the second partition wall defining the next outermost mixing chamber and alternating the spill over and flow under the partition walls in a radially outward direction.

In an alternate embodiment of the instant invention the inlet passageway is tangentially connected at the top of the inner mixing chamber. The partition walls are located in the annular housing such that the mixing materials flow under the first outwardly positioned wall continuing to the next subsequent wall for spillover. The discharge passageway is tangential to the annular housing and located in spaced relationship below the inlet passageway.

A method for mixing a mud slurry or liquid with solid or other flowable materials, for use in hydrocarbon drilling operations, for example, is also provided including tangentially feeding a mud slurry or liquid into an annular housing resulting in a high rotational velocity of the mud slurry forming a vortex or air core. Solid or liquid materials are mixed with the mud slurry by axially feeding of solids such as barite for example, into the vortex of the mixing chamber and allowing the centrifugal forces of the rotating liquid in the chamber to pull the solids through the liquid to the inner chamber wall. Further mixing of the solids is caused by high shearing action provided by the liquid being forced into concentric interfacial paths within the annular mixing chamber. The final mixing occurs when the solid-liquid slurry mixture spills over the first partition wall of the chamber into a second mixing chamber thus forcing the solid materials once again through the liquid against the surface of the inner wall. The mixture then flows under the subsequent partition wall with the rotational velocity moving the mixture in a upward direction so that there may be a second spill over of the third partition wall, for example. The retention of the kinetic energy by the continued rotation in the same direction of the mixture allows for discharging the homogeneous mixture at an elevation greater than that of the inlet passageway.

BRIEF DESCRIPTION OF THE DRAWINGS

FIG. 1 is a side section view of the mixing device in accordance with the present invention;

FIG. 2 is a partial section of the mixing device of FIG. 1 taken at lines 2—2 of FIG. 1;

DETAILED DESCRIPTION OF THE DRAWING

Figure 3:
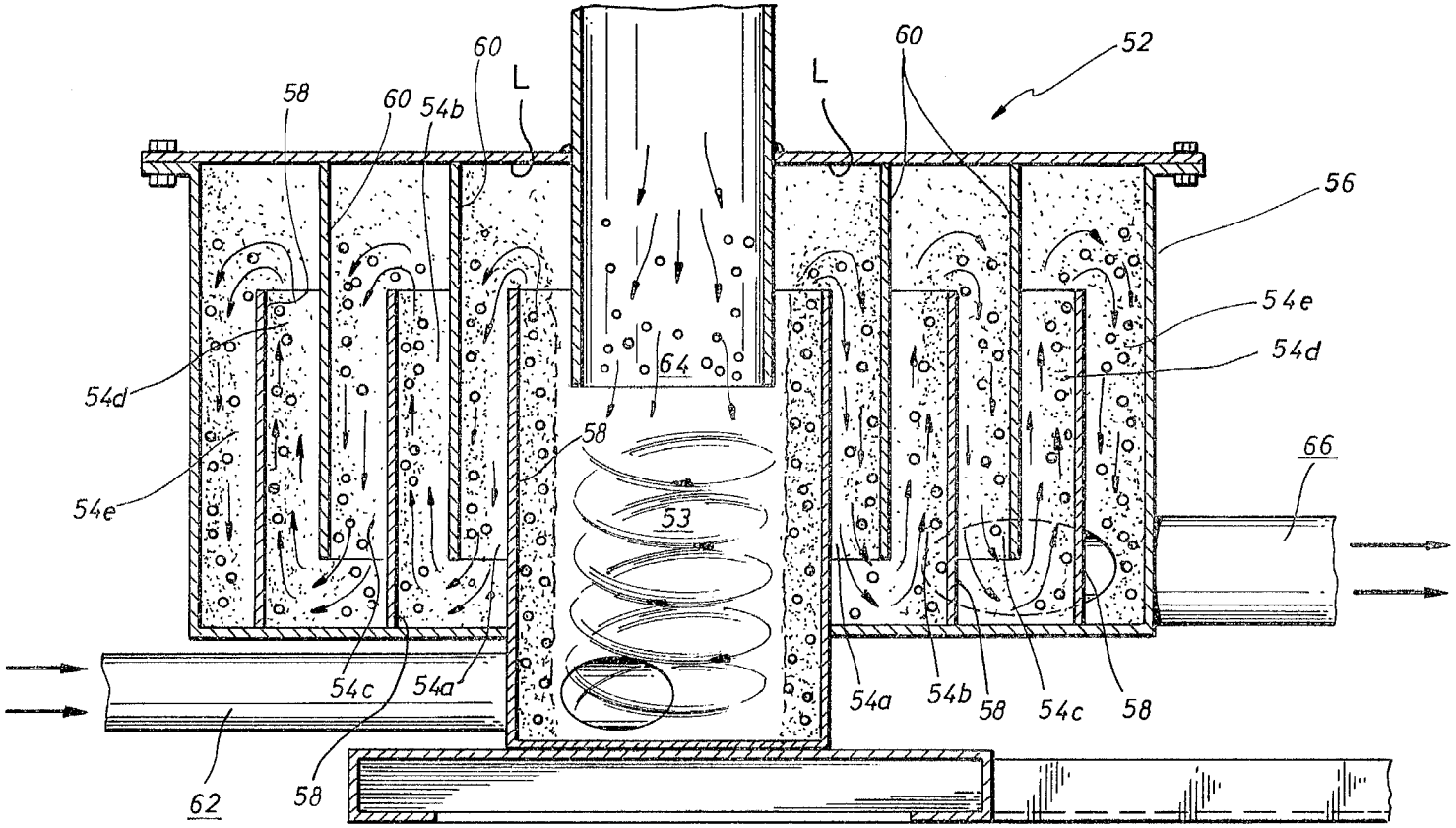
FIG. 3 is a side section view of a multi-stage centrifugal mixing device showing a plurality of mixing chambers in accordance with the present invention.

Referring now to the figures and more specifically to FIG. 1 where a centrifugal mud mixing device 10 is illustrated. An annular housing 12 is provided separated into an inner and outer mixing chamber 14 and 16. Mixing chambers 14 and 16 are divided by inner wall 18, and thus located in concentric relationship to one another.

An inlet passageway 20 is tangentially connected to mixing chamber 14 of annular housing 12 to provide a liquid or mud slurry to the mud mixing device 10 at a high rotational velocity. The inlet passageway 20 may be in the form of a metal or plastic tubular structure, for example.

A discharge port 22 is tangentially connected to the mixing chamber 16 of annular housing 12 for exhausting the mud slurry solid material mixture. Discharge port 22 may be located a significant elevational distance X from the inlet port 20.

Although the following description is directed to the embodiment of the invention directed to a solid-liquid mixture, it will be understood that two flowable materials may be mixed using a means for axially feeding the liquid, as a pipe, into the inner chamber 14.

To facilitate dispersing solid materials into the liquid or slurry, and more specifically into mixing chamber 14 for purposes of mixing with the mud slurry from inlet passageway 20 a funnel or solids hopper 24 is provided. Funnel 24 is attached to mixing chamber 14 and held in axial relationship to the same by means of a flange 26 cooperating with a sleeve 28 leading into the mixing chamber 14. In order to close off the mixing chamber from the outside environment at start-up a valve 30 is disposed between the funnel 24 and mixing chamber 14. The valve 30 may be a positive closure type valve, as for example a butterfly valve or a sliding valve. Opening and closing valve 30 may be accomplished by use of a lever or handle 32 functionally cooperating with valve 30.

Due to the abrasive nature of the mud slurry and the high density solids to be combined in a homogeneous mixture within the annular housing 12 a liner 34 covers the inside walls of both inner chamber 14 and outer chamber 16. The liner 34 may be a rigid liner such as ceramic or silicon carbide or may comprise a flexible liner such as rubber or polyurethane, for example.

The annular housing 12 as well as the funnel 24 connected thereto are supported by a skid 36. Further, to enable storing the solid materials before funneling them into the annular chamber 12 for purposes of mixing with the mud slurry mixture an apron 38 is connected to funnel 24 and further supported by skid 36. The "apron" as the term is commonly used in the mud-mixture art, is a planar member capable of supporting bulk dry materials. These materials may be stored in 100 pound bags, for example.

Operationally, the centrifugal mud mixing device 10 receives a mud slurry or liquid from a pressure nozzle 40 connected to the inlet passageway 20 which tangentially feeds the liquid or mud slurry into the annular housing 12 such that the liquid or slurry takes on a high rotational velocity. During the initial operation of the mud mixing device 10 the valve 30 is set with control handle 32 in a closed position thereby preventing the slurry mixture from blowing out the funnel 24. Due to the high rotational velocity of the mud slurry mixture a vortex 42 is formed in the mixing chamber 14. This vortex or air core 42 is maintained throughout the mixing cycle to prevent blowout of the mixture through the funnel 24 and to draw a vacuum to enable proper axial dispersement of the solid materials from funnel or solids hopper 24. The size of vortex 42 is of importance in that it must be greater than the width of the sleeve 28 in order to accomplish its function of preventing blowout of the mud slurry. The maintenance and size of the vortex 42 is accomplished by applying the mud slurry at a pressure of predetermined value which yields a rotational velocity great enough to generate a vortex or air core 42 with sufficient dimension. The calculation for pressure head at the inlet passageway 20 to obtain a proper vortex in the annular chamber 14 requires the consideration of the size of the annular chamber 14 as well as the dimension of the sleeve 28, since any backflow from the mixing chamber 14 will by necessity be transmitted through sleeve 28. Therefore, if a smaller annular housing is used the vortex generated by the rotational velocity of the mud slurry will be significantly smaller thereby requiring a corresponding reduction in any sleeve used to axially disperse solids into the mixing chamber.

After the vortex 42 is formed the control handle 32 is used to open valve 30, allowing the dispersion of solid materials 44 into the mixing chamber 14. The solid materials may be high density solids, such as barium sulfate for example, or lower density solids, such as bentonite, gel, walnut hulls or feathers and other loss circulation materials. The lower density solids would be preferable in obtaining the proper viscosity of mud to enable floating or carrying cuttings of the drilling operation to the top of the drill hole, while the higher density materials are used to suppress the formation pressures at the bottom of the drill hole.

Once the solids 44 are collected at the bottom of the annular mixing chamber 14 the centrifugal force created by the high rotational velocity pulls the solid materials 44 through the mud slurry so as to ultimately circulate within the chamber 14 close to the inner wall 18. Using an inlet pressure of 20 psi may generate a centrifugal force of up to 500 g. for example. Further, high shearing action is provided by the liquid being forced into concentric circular paths of liquid in interfacial relationship. Thus, the solids are further mixed by this shearing force as they are propagated in a rotational manner within the annular housing 14. Due to the high rotational velocity the mud slurry-solid mixture will climb in an upward direction along the surface of inner wall 18 within annular housing 14 and finally spill over inner wall 18 into the outer chamber 16. During the spillover the mixture is inverted. Since the mud slurry-solids mixture continues its rotation in the same direction as within the annular mixing chamber 14 while disposed in annular mixing chamber 16 the same mixing forces take place. Thus, the solid materials 44 are forced radially outward against the outer wall of mixing chamber 16 and mixed by the centrifugal force as well as the shearing action taking place with the concentric liquid paths within the mixing chamber 16. Also, the turbulence of the mixture at spillover is a further enhancement of the mixing function and provides for a more homogeneous mixture of the mud slurry and solid materials 44.

Referring now to FIG. 2 where a partial section of the mud mixing device 10 is illustrated, the mud slurry mixture rotates in the same direction 50 in both the inner chamber 14 and the outer chamber 16. By retaining the rotational velocity in the outer chamber 16 in the same direction as the rotation of the mud slurry within the inner chamber 14 the kinetic energy of the mixture is retained and thus enables the discharge of the homogeneous mud slurry-solids material mixture from a tangential discharge port connected to the outer chamber 16 disposed in an elevational relationship above the inlet passageway 20.

The solid materials 44 are pulled into the mixing chamber 14 by a vacuum created by the rotating velocity of the mud slurry and by force of gravity. This vacuum effect permits handling high volumetric rates of solid as for example 7.5 cubic feet per minute of barium sulfate and high mud rates such as 950 gallons per minute.

FIG. 3 represents the preferred embodiment of the invention and illustrates a multi-stage mud mixing device 52. The multi-stage device 52 has a plurality of mixing chambers 54 extending radially outward from one another. The annular housing 56 is divided into the mixing chambers 54*a–e* by partition walls 58 and 60.

The partition walls 58 are located within the annular housing 56 so that the solid materials axially fed from openings 64 and the liquid material fed from inlet passageway 62 may spill over each of these walls. The partition walls 60 are disposed in the annular housing 56 to allow the solid-liquid mixture to flow under the partition wall into the next subsequent chamber 54*b* and 54*d*.

Operationally, a liquid or slurry material is tangentially fed through openings 62 into the innermost mixing chamber 53 to be mixed with solids fed through openings 64. The rotational velocity of the liquid will cause a mixing operation in the innermost chamber 53 and further cause the solid-liquid mixture to climb in an upward direction along the inner surface of the wall 58. The mixture will then spill over into the next outermost chambers 54*a*, 54*c*, and 54*e* under partition wall 60 once again climbing the next subsequent partition wall 58. After the mixture has spilled over the last partition wall 58 the rotational velocity will cause the liquid to exit out of the output port 66. The upward movement of the solid liquid mixture in conjunction with the spillover over the partition walls 58 and the continued rotational movement of the mixture under the partition wall 60 and then up again over the next subsequent partition wall 58 enhances the mixing operation of the device 52.

In view of the abrasive nature of the liquid/solid mixture, a liner "L" as shown in FIG. 3 is provided to preserve the integrity of the inside of the annular housing 56, and more specifically, the integrity of the mixing chambers 54*a–e*.

While the invention has been described and illustrated with respect to specific embodiments it will be understood that other embodiments and modifications in accordance with the spirit and scope of the invention are contemplated.

Figure 4:
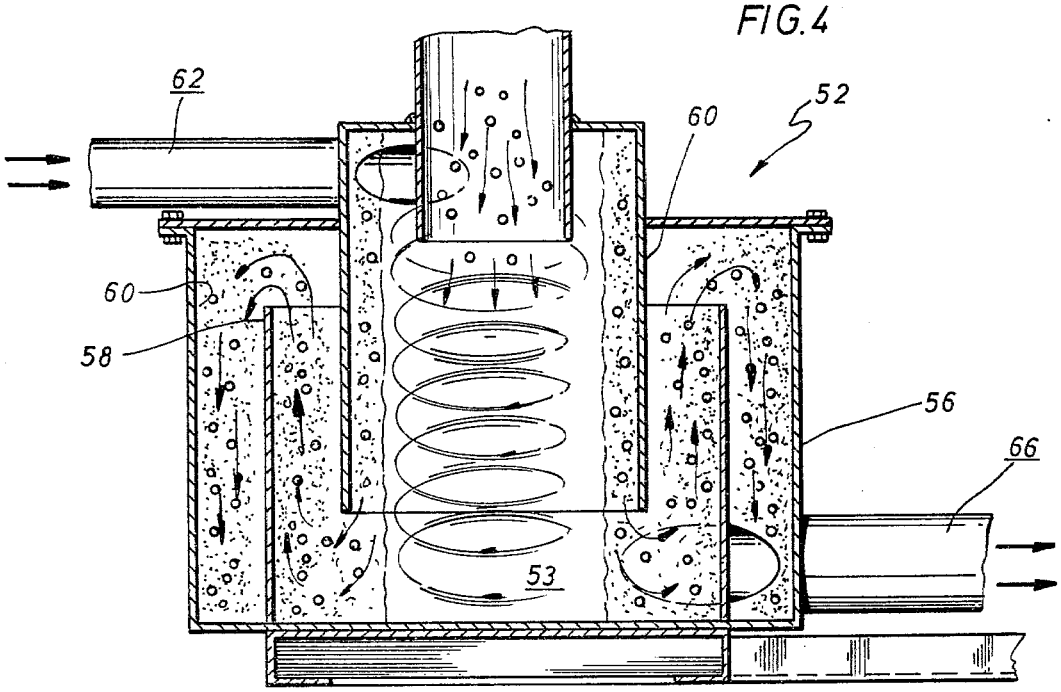
FIG. 4 is a side view of a multistage centrifugal mixing device with the inlet passageway connected near the top of the annular housing.

For example, as shown in FIG. 4, the inlet passageway 62 may be located near the top of the annular housing 56 providing a tangential feed of materials into the chamber 53. The partition walls 58 and 60 would in this embodiment be reversed, that is, the mixture of materials would first flow under a partition wall 60 and then moving radially outward will spill over a partition wall 58. The discharge port or outlet passageway 66 may be located so as to be in spaced parallel relationship below the inlet passageway 62.

Also, it is understood that the hopper 24 and apron 38 shown in FIG. 1 are also part of the apparatus illustrated in FIGS. 3 and 4. The hopper 24 is used for feeding the solid materials into the mixing chamber, and the apron 38 is utilized for storing the dry solid materials.

Figure 5:
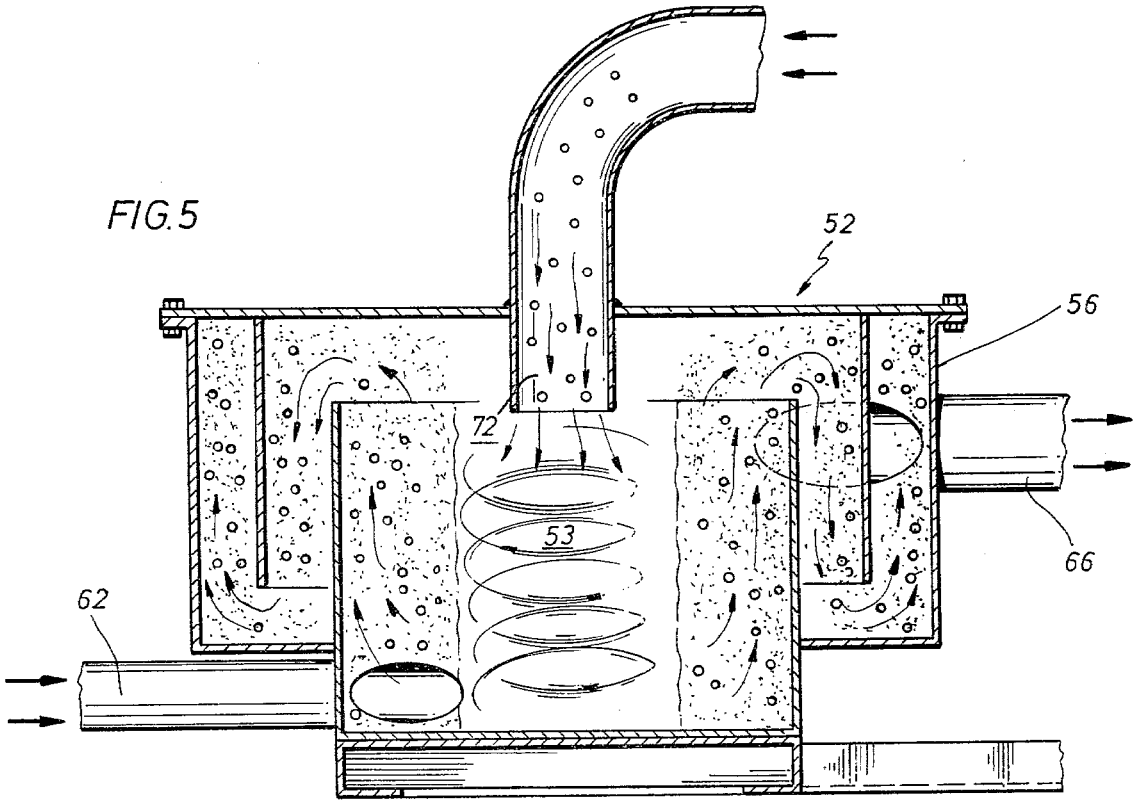
FIG. 5 is a side view of a centrifugal mud mixer having a means for axially feeding a flowable material.

Further, the centrifugal mud mixer of the present invention may be utilized for mixing two flowable materials. FIG. 5 illustrates the mud mixer 52 having a conduit 70 located in axial relationship with the inner chamber 53 for feeding a flowable material 72.

What is claimed is:

1. Apparatus for mixing flowable materials with solid material for use in hydrocarbon drilling operations, comprising:

an annular housing having an inner chamber for mixing materials;

an inlet tangentially connected to said inner chamber for feeding a flowable material into said inner chamber, causing centrifugal motion and thus creating a vortex in said flowable material;

means operatively associated with said annular housing and axially connected thereto, for feeding solid materials into said flowable materials;

means for mixing said flowable materials and said solid materials comprising a series of partition walls extending radially outward from said inner chamber, said partition walls disposed within said chamber in spaced parallel relation to one another, thereby defining a plurality of mixing chambers, with each of said partition walls having a length less than the inside diameter of said inner chamber alternately affixed to the top and bottom of said inner chamber.

2. Apparatus for mixing flowable materials with solid material for use in hydrocarbon drilling operations, comprising:

an annular housing having an inner chamber for mixing materials;

an inlet tangentially connected to said inner chamber for feeding a flowable material into said inner chamber, causing centrifugal motion and thus creating a vortex in said flowable material;

means operatively associated with said annular housing and axially connected thereto, for feeding solid materials into said flowable materials;

means for mixing said flowable materials and said solid materials comprising at least one first partition wall and at least one second partition wall defining outer mixing chambers and located outwardly from said inner chamber, said first and second partition walls disposed within said inner chamber in spaced parallel relation to one another with each of said at least one first and at least one second partition wall having a length less than the inside diameter of said inner chamber and said at least one first partition wall affixed to the bottom of said inner chamber and said at least one second partition wall affixed to the top of said inner chamber for providing a flow path of said solid and liquid materials to alternately flow over said at least one first partition wall and under said at least one second partition wall; and an outlet tangentially connected to said annular housing, located in spaced relationship above said inlet and outwardly of said first and second partition walls for discharging a mixture of said flowable materials and said solid materials.

3. Apparatus for mixing as set forth in either of claims 1 or 2 wherein said flowable material comprises a mud slurry mixture.

4. Apparatus as set forth in either of claims 1 or 2 wherein said solid materials comprise barium sulfate.

5. An apparatus as set forth in either of claims 1 or 2 further including a valve disposed between said annular housing and said means for feeding solid materials for controlling the dispersion of solid materials into said flowable materials.

6. An apparatus for mixing as set forth in claim 5 further including valve control means for adjusting the dispersion of said solid materials into said flowable material.

7. An apparatus for mixing as set forth in either of claims 1 or 2 wherein said inlet and outlet comprise tubular passageways.

8. An apparatus as set forth in either of claims 1 or 2 further including storage means connected to said means for feeding solid materials, for storing bulk quantities of said solid materials.

9. Apparatus for mixing as set forth in claim 8 wherein said storage means comprises a storage apron.

10. Apparatus for mixing as set forth in either of claims 1 or 2 further including means for supporting said annular housing.

11. Apparatus for mixing as set forth in either of claims 1 or 2 wherein said solid materials comprise materials having a densities in the range of 0.8 to 5.0.

12. Apparatus for mixing as set forth in either of claims 1 or 2 wherein said solid materials comprise bentonite.

13. Apparatus for mixing as set forth in either of claims 1 or 2 further including a liner disposed within said annular housing for shielding against abrasion.

14. An apparatus for mixing as set forth in either of claims 1 or 2 wherein said means for feeding solid materials comprises a funnel.

15. A mixing apparatus comprising:

a housing having an inner chamber for mixing materials;

an inlet tangentially connected to said inner chamber for feeding a flowable material into said housing, causing a centrifugal motion and thus creating a vortex in said flowable material;

means operatively associated with said housing and axially connected thereto, for feeding solid materials into said flowable materials;

means for mixing said flowable materials and said solid materials comprising a series of partition walls extending radially outward from said inner chamber, said partition walls disposed within said chamber in spaced parallel relation to one another, thereby defining a plurality of mixing chambers, with each of said partition walls having a length less than the inside diameter of said inner chamber alternately affixed to the top and bottom of said inner chamber; and an outlet tangentially connected to said housing, located in spaced relationship with said inlet and outwardly of said first and second partition walls for discharging a mixture of said flowable materials and said solid materials.

16. A mixing apparatus comprising:

a housing having an inner chamber for mixing materials;

an inlet tangentially connected to said inner chamber for feeding a flowable material into said housing, causing a centrifugal motion and thus creating a vortex in said flowable material;

means operatively associated with said housing and axially connected thereto, for feeding solid materials into said flowable materials;

means for mixing and combining said flowable materials and said solid materials comprising at least one first partition wall and at least one second partition wall defining outer mixing chambers and located outwardly from said inner chamber, said first and second partition walls disposed within said inner chamber in spaced parallel relation to one another with each of said at least one first and at least one second partition wall having a length less than the inside diameter of said inner chamber and said at least one first partition wall affixed to the bottom of said inner chamber and said at least one second partition wall affixed to the top of said inner chamber for providing a flow path of said solid and liquid materials to alternately flow over said at least one first partition wall and under said at least one second partition wall; and an outlet tangentially connected to said housing, located in spaced relationship with said inlet and outwardly of said first and second partition walls for discharging a mixture of said flowable materials and said solid materials.

17. A mixing apparatus comprising:

an annular housing having an inner chamber for mixing materials;

an inlet tangentially connected to said inner chamber for feeding a flowable material into said inner chamber, causing centrifugal motion and thus creating a vortex in said flowable material;

means operatively associated with said annular housing and axially connected thereto, for feeding materials into said flowable materials;

means for mixing said flowable materials and said solid materials comprising at least one first partition wall and at least one second partition wall defining outer mixing chambers and located outwardly from said inner chamber, said first and second partition walls disposed within said inner chamber in spaced parallel relation to one another with each of said at least one first and at least one second partition wall having a length less than the inside diameter of said inner chamber and said at least one first partition wall affixed to the bottom of said inner chamber and said at least one second partition wall affixed to the top of said inner chamber for providing a flow path of said solid and liquid materials to alternately flow over said at least one first partition wall and under said at least one second partition wall; and an outlet tangentially connected to said annular housing, located in spaced relationship with said inlet and outwardly of said first and second partition walls for discharging said mixture of materials.

18. A mixing apparatus as set forth in either of claims 16 or 17, wherein said means for feeding axially fed materials comprises a conduit located in axial relationship with said inner chamber.

19. A mixing apparatus as set forth in either of claims 16 or 17, wherein said inlet is disposed in spaced relationship above said outlet.

20. A mixing apparatus as set forth in claim 17, wherein said axially fed materials are solid materials.

21. A mixing apparatus as set forth in claim 20, wherein said solid materials are loss circulation materials.

22. A mixing apparatus as set forth in claim 17, wherein said axially fed materials are flowable materials.

23. A method for mixing flowable materials with solid materials for use in hydrocarbon drilling operations comprising the steps of:

tangentially feeding a flowable material into an annular housing having a plurality of mixing chambers for mixing so as to create a centrifugal motion in said flowable material resulting in forming a vortex in said flowable material;

axially feeding solid materials into said vortex within said annular housing for obtaining a high density mixture;

mixing said solid materials with said flowable materials by centrifugal motion, propagating said solid materials in a radially outward direction;

combining said mixture of said flowable and said solid materials by alternately spilling said mixture over and passing said mixture under a series of partition walls while maintaining the rotational velocity of said mixture in the same direction of rotation throughout said annular housing; and tangentially discharging said mixture from said annular housing.

24. A method for mixing flowable materials with solid materials for use in hydrocarbon drilling operations comprising the steps of:

tangentially feeding a flowable material into an annular housing having a plurality of mixing chambers for mixing so as to create a centrifugal motion in said flowable material resulting in forming a vortex in said flowable material;

axially feeding solid materials into said vortex within said annular housing for obtaining a high density mixture;

mixing said solid materials with said flowable materials by centrifugal motion, propagating said solid materials in a radially outward direction;

combining said mixture of said flowable and said solid materials by spilling said mixture over a first partition wall and passing said mixture under a second partition wall moving in a radially outward direction while retaining the rotational velocity of said mixture in the same direction of rotation throughout said annular housing; and tangentially discharging said mixture from said annular housing.

* * * * *